US008550659B1

(12) United States Patent
Lin et al.

(10) Patent No.: US 8,550,659 B1
(45) Date of Patent: Oct. 8, 2013

(54) MODULAR LAMP COVER

(75) Inventors: Chu-Keng Lin, Miao-Li (TW); Sung-Hsiang Yang, Miao-Li (TW); Wei-Chun Yeh, Miao-Li (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 0 days.

(21) Appl. No.: 13/492,927

(22) Filed: Jun. 11, 2012

(30) Foreign Application Priority Data

Apr. 9, 2012 (TW) ..... 101112428

(51) Int. Cl.
*F21V 5/04* (2006.01)

(52) U.S. Cl.
USPC ..... 362/240; 362/244; 362/332; 362/367

(58) Field of Classification Search
USPC ..... 362/640, 655, 240, 244, 367, 332, 238
See application file for complete search history.

(56) References Cited

U.S. PATENT DOCUMENTS

| | | | | |
|---|---|---|---|---|
| 7,524,080 | B2 * | 4/2009 | Tu et al. | 362/183 |
| 7,703,941 | B2 * | 4/2010 | Lee | 362/219 |
| 8,029,177 | B2 * | 10/2011 | Schmierer | 362/545 |
| 8,287,152 | B2 * | 10/2012 | Gill | 362/249.02 |
| 2006/0152945 | A1 * | 7/2006 | Lantzsch et al. | 362/640 |

* cited by examiner

*Primary Examiner* — Peggy A. Neils
(74) *Attorney, Agent, or Firm* — Altis & Wispro Law Group, Inc.

(57) ABSTRACT

An exemplary lamp cover for covering a light source includes a connecting member, mounting members, first covering members, and a second covering member. The mounting members are integrally formed with the connecting member as a single piece. The first covering members are detachably mounted on the connecting member and alternated with the mounting members. The second covering member is capable of being mounted on the connecting member to replace one of the first covering members to change a shape of a light field of light emitted from the light source and through the lamp cover.

20 Claims, 3 Drawing Sheets

MODULAR LAMP COVER

BACKGROUND

1. Technical Field

The disclosure generally relates to a lamp cover, and particularly to a modular lamp cover which can be easily altered to change the light field of light generated by a light source which is covered by the modular lamp cover.

2. Description of Related Art

A conventional lamp includes a plurality of light sources and a cover covering the light sources. Light emitted from the light sources penetrates the cover and forms a specifically-shaped light field. When the shape of the light field is needed to be changed, the cover will be entirely replaced by another cover having a different optical configuration. This is a time-consuming and costly requirement.

What is needed, therefore, is an improved lamp cover to overcome the above described shortcomings.

DETAILED DESCRIPTION

Embodiments of lamp covers will now be described in detail below and with reference to the drawings.

Figure 1:
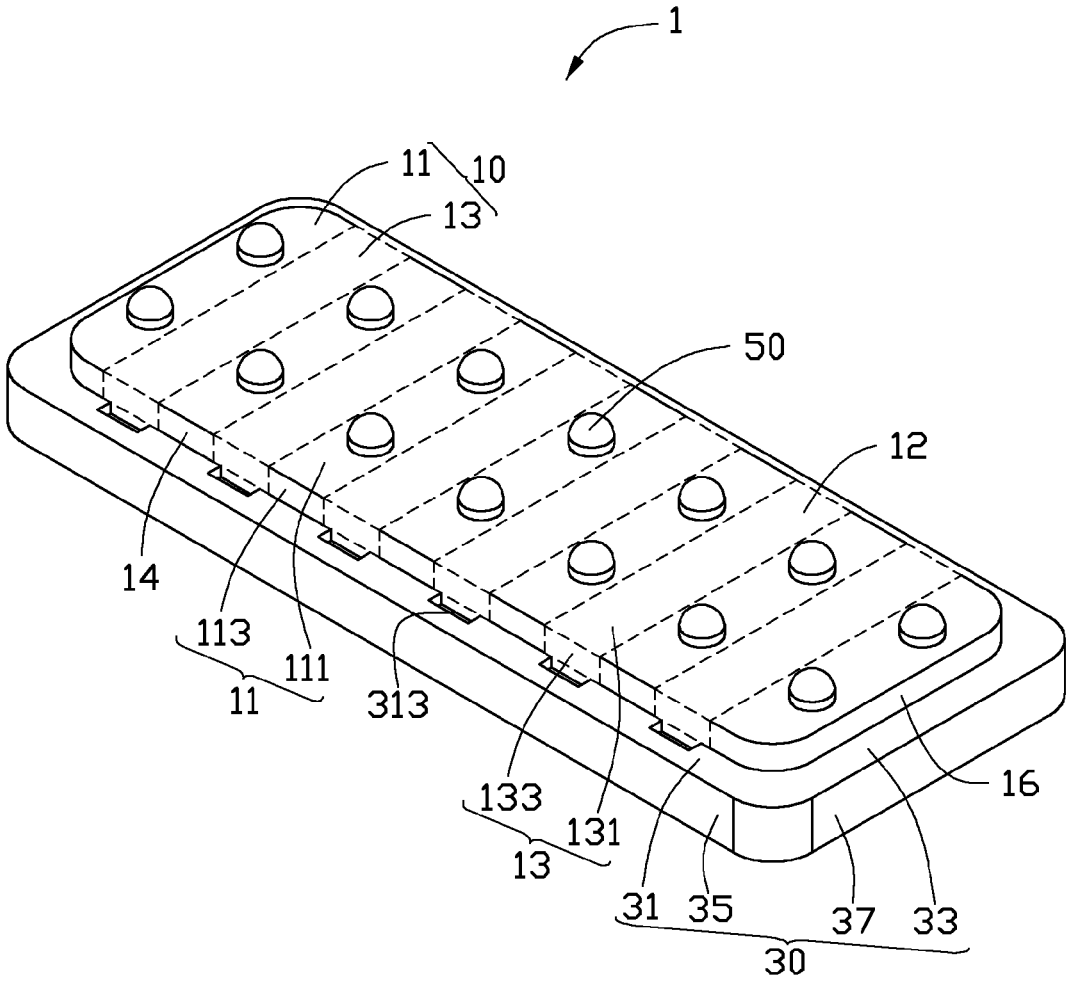
FIG. 1 is an assembled, isometric view of a lamp cover according to an embodiment of the present disclosure, wherein first covering members are removably mounted to a connecting member and engage with mounting members.

Referring to FIG. 1, a lamp cover 1 in accordance with a first embodiment is adapted for covering a light source (not shown) and allows light emitted from the light source penetrating therethrough to form a light filed having a predetermined shape. The lamp cover 1 includes a main body 10, a connecting member 30 extending downwardly from an outer periphery of the main body 10, and a plurality of lenses 50 mounted on the main body 10. The main body 10 and the connecting member 30 are opaque and cooperatively define a chamber (not labeled) therebetween which receives the light source therein, and light emitted from the light source penetrates through the lamp cover 1 only from the lenses 50.

The main body 10 includes a plurality of mounting members 11 integrally formed with the connecting member 30 as a single piece and a plurality of first covering member 13 detachably mounted on the connecting member 30. The mounting members 11 and the first covering members 13 are alternated with each other. Each mounting member 11 has a U-shaped configuration, and includes an elongated first supporting plate 111 and two first end plates 113 extending downwardly from opposite ends of the first supporting plate 111, respectively. The lenses 50 are mounted on the first supporting plate 111. Light emitted from the light source penetrates through the lenses 50 to form the light field with the predetermined shape. In this embodiment, the lenses 50 mounted on each first supporting plate 111 have a number of two.

A configuration of each first covering member 13 is similar to that of the mounting member 11. Each first covering member 13 includes an elongated second supporting plate 131 and two second end plates 133 extending downwardly from opposite ends of the second supporting plate 131, respectively. Each first covering member 13 is sandwiched between two adjacent mounting members 11.

The first supporting plates 111 and the second supporting plates 131 are coplanar and cooperatively form a top plate 12 of the main body 10. The first end plates 113 and the second end plates 133 which are located at corresponding sides of the first supporting plates 111 and the second supporting plates 131 are coplanar and cooperatively form two parallel side plates 14. Two elongated flanges 16 extend downwardly from outer edges of the two first supporting plates 111 of the two mounting members 11 located at the outmost ends of the main body 10, respectively. The flanges 16 interconnect the first end plates 113 of the corresponding mounting members 11. Thus, the flanges 16, the top plate 12, the side plates 14 cooperatively form the mounting member 11 at the outmost end of the main body 10. Since the first covering members 13 are removably mounted to the connecting member 30, the first covering members 13 are easily disassembled from the connecting member 30 and mounting members 11 by snatching the first covering member 13 out of the connecting member 30 of the lamp cover 1.

The connecting member 30 includes two first connecting arms 31, two second connecting arms 33, two first extending arms 35 and two second extending arms 37. The first connecting arms 31 are elongated and parallel to each other. The first connecting arms 31 horizontally extend outwardly from out surfaces of bottom ends of the side plates 14 of the mounting members 11. The second connecting arms 33 are elongated and parallel to each other, but shorter than the first connecting arms 31. The second connecting arms 33 horizontally extend outwardly from bottom ends of the flanges 16 of the mounting members 11 at the outmost ends of the main body 10. The second connecting arms 33 interconnect the first connecting arms 31. The first extending arms 35 are elongated and parallel to each other. The first extending arms 35 vertically extend downwardly from outside ends of the first connecting arms 31. The second extending arms 37 are elongated and parallel to each other, but shorter than the first extending arms 35. The second extending arms 37 vertically extend downwardly from outside ends of the second connecting arms 33. The second extending arms 37 interconnect the first extending arms 35.

A plurality of cutouts 313 is defined in an edge of each of the first connecting arms 31 adjacent the main body 10, and each cutout 313 is located between two neighboring mounting members 11. The cutout 313 is U-shaped. A width of the cutout 313 along a longitudinal direction of the main body 10 is less than that of the second end plate 133. In this state, only opposite sides of each of the second end plates 133 connect the first connecting arms 31. Therefore, the first connecting arms 31 are easily to be disassembled from the first connecting arms 31.

Figure 2:
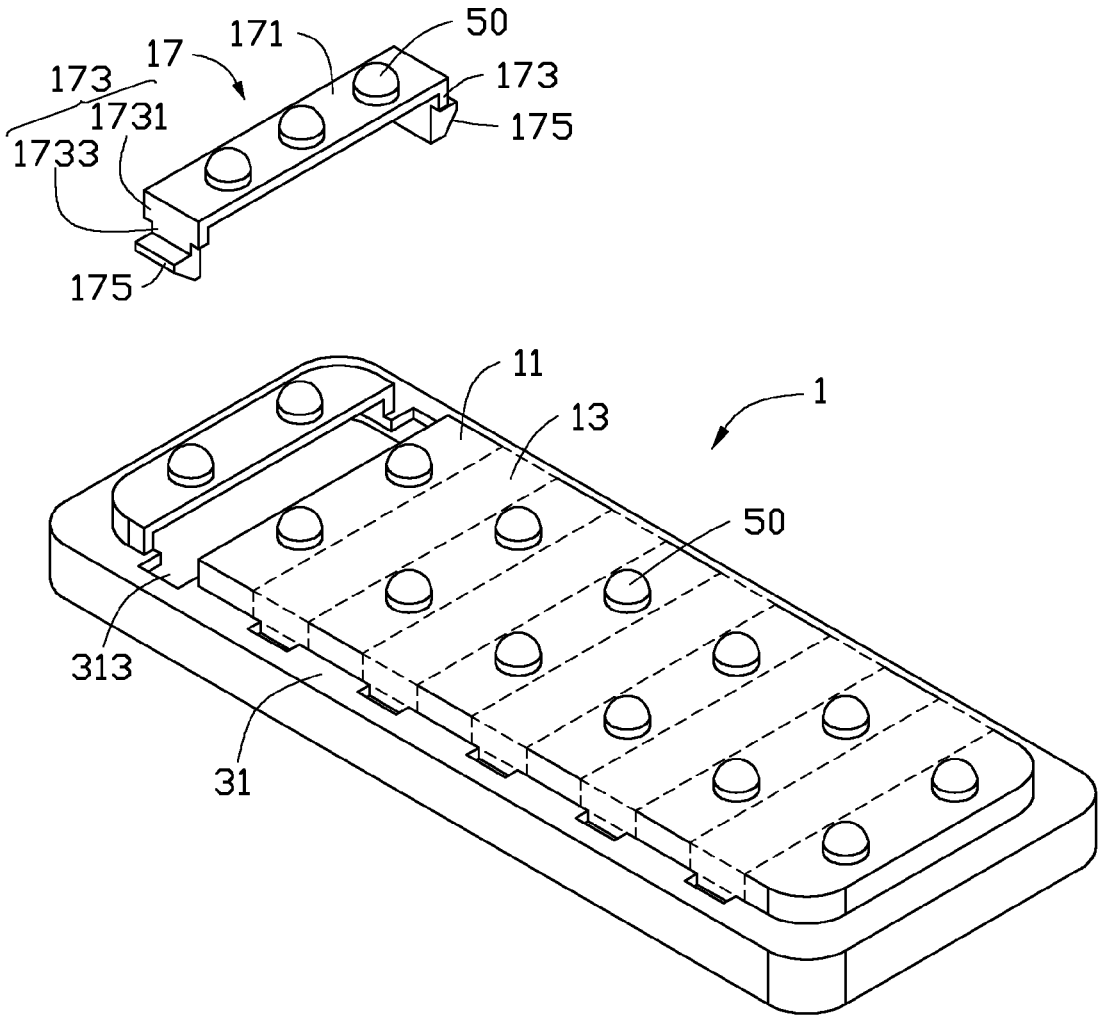
FIG. 2 is similar to FIG. 1, but one of the first covering members is removed from the lamp cover and a second covering member is to be removably mounted to the lamp cover.
Figure 3:
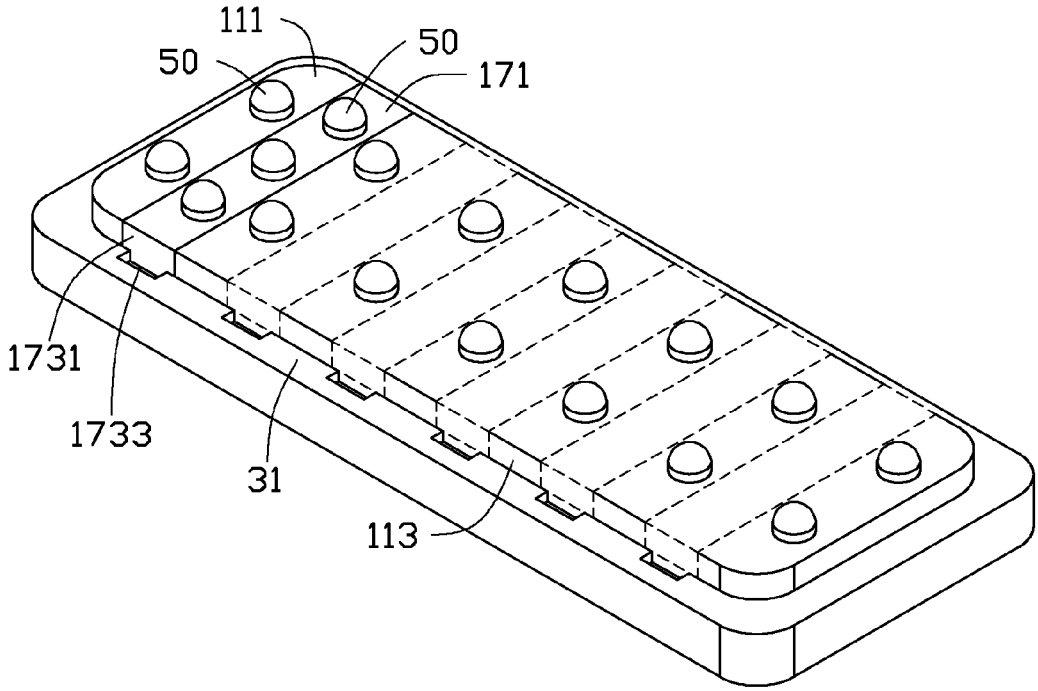
FIG. 3 is similar to FIG. 1, but the second covering member is removably mounted to the lamp cover.

Referring to FIGS. 2-3, when the shape of the light field is needed to be changed, a second covering member 17 is provided to replace one of the first covering members 13 to adjust the shape of the light field.

The second covering member 17 includes an elongated third supporting plate 171, two third end plates 173 extending respectively down from opposite ends of the third supporting plate 171, and two resisting portions 175 respectively formed on bottom ends of the third end plates 173. A size of the third supporting plate 171 is the same as that of the second supporting plate 131. Three spaced lenses 50 are mounted on the third supporting plate 171 and aligned with each other. Each third end plate 173 includes a rectangular arm 1731 extending downwardly from the third supporting plate 171 and a rectangular stretching portion 1733 extending downwardly form a central portion of a bottom end of the arm 1731. The arm 1731 and the stretching portion 1733 are integrally formed as a single piece and have a T-shaped configuration. A size of the arm 1731 is the same as that of the second end plate 133 of the first covering member 13. The resisting portions 175 are protruded outwardly from bottom ends of the stretching portions 1733. Each resisting portion 175 is a triangular prism and a thickness thereof decreases from an inner end connecting the stretching portion 1733 to an outer end away from the stretching portion 1733.

When one of the first covering members 13 is disassembled from the cover 1, the second covering member 17 is aligned with a vacant opening (not labeled) which is originally occupied by the disassembled first covering member 13. The second covering member 17 is pressed towards the opening to make the resisting portions 175 slide downwardly along the cutouts 313 until the bottom ends of the arms 1731 abut top surfaces of the first connecting arms 31. In this state, the second covering member 17 is sandwiched between the two adjacent mounting members 11. The third supporting plate 171 and the second supporting plate 131 are coplanar. The arms 1731 and the second end plates 133 are coplanar. The resisting portions 175 and stretching portions 1733 are received in the connecting member 30. The outer ends of the resisting portions 175 elastically abut against inner surfaces of the first extending arms 35. Furthermore, the resisting portions 175 elastically abut against bottom surfaces of the first connecting arms 31, whereby the second covering member 17 is removably secured to the lamp cover 1.

It can be understood that the number of the second covering member 17 is not limited one. The number is adjustable, following the number of the first covering members 13 which is needed to be replaced, wherein the number may be two or three as long as it can meet different requirements.

It is to be further understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A lamp cover for covering a light source, comprising:

a connecting member;

at least one first covering member detachably mounted on the connecting member; and at least one mounting member integrally formed with the connecting member as a single piece and located neighboring the at least one first covering member;

wherein light emitted from the light source is capable of penetrating through the at least one first covering member and the at least one mounting member to form a light field having a shape, when the shape of the light field of the light is needed to changed, the at least one first covering member is disassembled from the connecting member and replaced by a second covering member having a size the same as the at least one first covering member but with a different optical configuration.

2. The lamp cover of claim 1, wherein the at least one mounting member comprises a plurality of mounting members mounted on the connecting member, the at least one first covering member comprises a plurality of the first covering members detachably mounted on the connecting member, the mounting members and the first covering members are alternated with each other, and the second covering member replaces one of the first covering members.

3. The lamp cover of claim 2, wherein each mounting member comprises a first supporting plate and two first end plates extending downwardly from opposite ends of the first supporting plate, each first covering member comprising a second supporting plate and two second end plates extending downwardly from opposite ends of the second supporting plate, the first supporting plates and the second supporting plates are coplanar and cooperatively form a top plate, the first ends plates and the second end plates located at corresponding sides of the first supporting plates are coplanar and cooperatively form two parallel side plates, and the side plates connect the connecting member.

4. The lamp cover of claim 1, wherein the at least one mounting member comprises a first supporting plate and two first end plates extending downwardly from opposite ends of the first supporting plate, the second covering member comprises a third supporting plate and two arms extending downwardly from opposite ends of the third supporting plate, after the second covering member replacing the at least one first covering member, the third supporting plate and the first supporting plate are coplanar, and the arms and the first end plates are coplanar.

5. The lamp cover of claim 2, wherein the connecting member comprises two first connecting arms extending outwardly from bottom ends of the side plates, and two first extending arms extending downwardly from outer edges of the first connecting arms.

6. The lamp cover of claim 5, wherein a plurality of cutouts is defined in the first connecting arms, the second covering member comprises a third supporting plate and two arms extending downwardly from opposite ends of the third supporting plate, after the second covering member replacing one of the first covering members, the third supporting plate and the first supporting plates are coplanar, the arms and the first end plates are coplanar and opposite ends of each of the arms abut against a top of a corresponding first connecting arm.

7. The lamp cover of claim 6, wherein the second covering member comprises two stretching portions extending downwardly form central portions of bottom ends of the arms and received in the cutouts.

8. The lamp cover of claim 7, wherein the second covering member further comprises two resisting portions protruded outwardly from bottom ends of the stretching portions and elastically abut against inner surfaces of the first extending arms and bottoms of the first connecting arms.

9. The lamp cover of claim 8, wherein each resisting portion is a triangular prism and a thickness thereof decreases from an inner end connecting the stretching portion to an outer end away from the stretching portion, and the outer end abuts against one of the inner surfaces of the first extending arms.

10. The lamp cover of claim 5, wherein each first covering member is sandwiched between two adjacent mounting members, and two flanges extend downwardly from outer edges of the two first supporting plates of the two mounting members located near the outmost ends of the lamp cover to connect the side plates and the top plate.

11. The lamp cover of claim 10, wherein the connecting member comprises two second connecting arms extending outwardly from bottom ends of the flanges and interconnecting the first connecting arms, and two second extending arms extending downwardly from outer ends of the second connecting arms and interconnecting the first extending arms.

12. The lamp cover of claim 2, wherein at least a lens is mounted on each of the mounting members, and at least a lens is mounted on the second covering member.

13. The lamp cover of claim 12, wherein the mounting members, the first covering members, the second covering member and the connecting member are opaque.

14. A lamp cover for covering a light source, comprising:

a connecting member;

a plurality of mounting members mounted on the connecting member and integrally formed with the connecting member as a single piece;

a plurality of first covering members detachably mounted on the connecting member and alternated with the mounting members; and a second covering member;

wherein the second covering member is capable of being mounted on the connecting member to replace one of the first covering members to change a shape of a light field generated by a light radiating through the mounting members and the first covering members of the lamp cover.

15. The lamp cover of claim 14, wherein a plurality of lenses are respectively mounted on the mounting members and the second covering member.

16. The lamp cover of claim 15, wherein the mounting members, the first covering members, the second covering member and the connecting member are opaque and cooperatively form a chamber, and light emitted from the light source penetrates through the lamp cover only from the lenses.

17. The lamp cover of claim 15, wherein the second covering member comprises a third supporting plate and two resisting portions protruded from opposite ends of the third supporting plate, the lenses are mounted on the third supporting plate, and the resisting portions are received in the connecting member and elastically abut against inner surfaces of the connecting member to assemble the second covering member on the connecting member.

18. The lamp cover of claim 17, wherein the second covering member further comprises two third end plates, each third end plate comprises an arm extending downwardly from one of ends of the third supporting plate and a stretching portion extending downwardly from a central portion of a bottom end of the arm, the stretching portion connects the resisting portion and is received in the connecting member, and opposite sides of the bottom end of the arm abut against a top surface of the connecting member.

19. The lamp cover of claim 18, wherein each mounting member comprises a first supporting plate and two first end plates extending downwardly from opposite ends of the first supporting plate, each first covering member comprising a second supporting plate and two second end plates extending downwardly from opposite ends of the second supporting plate, before the second covering member replacing one of the first covering members, the first supporting plates and the second supporting plates are coplanar and cooperatively form a top plate, the first ends plates and the second end plates located at corresponding sides of the first supporting plates are coplanar and cooperatively form two parallel side plates, and the side plates connect the connecting member.

20. The lamp cover of claim 19, wherein the third supporting plate and the first supporting plate are coplanar, and the arms and the first end plates are coplanar after the second covering member replacing one of the first covering members.

* * * * *